United States Patent [19]

Chaffey

[11] Patent Number: 4,651,500

[45] Date of Patent: Mar. 24, 1987

[54] METHOD AND APPARATUS FOR WRAPPING ROLLS OF PAPER

[75] Inventor: Lloyd S. Chaffey, Green Bay, Wis.

[73] Assignee: Valley Tissue Packaging, Inc., Green Bay, Wis.

[21] Appl. No.: 701,754

[22] Filed: Feb. 14, 1985

[51] Int. Cl.[4] ..... B65B 71/22

[52] U.S. Cl. ..... 53/204; 53/228; 53/380; 269/269

[58] Field of Search ..... 53/204, 226, 228, 232, 53/380; 269/156, 203, 269, 902, 908; 248/172

[56] References Cited

U.S. PATENT DOCUMENTS

| | | | |
|---|---|---|---|
| 510,293 | 12/1893 | Richards | 269/156 |
| 1,530,795 | 3/1925 | Teller | 269/156 |
| 2,301,016 | 11/1942 | Cannard | 53/204 |
| 2,380,816 | 7/1945 | Witbro | 53/204 X |
| 2,877,612 | 3/1959 | Berney | 53/204 X |
| 3,385,026 | 5/1968 | Schmermund | 53/228 |
| 3,904,158 | 9/1975 | Michael | 248/172 X |

*Primary Examiner*—John Sipos

[57] ABSTRACT

An apparatus for wrapping rolls of paper includes a wrapping material feed system for deliverying sheets of wrapping material and includes spaced apart vacuum belts and a conveyor for delivering the rolls to be wrapped in a path which intersects that of the vacuum belts. The rolls are successively moved downwardly between the belts for displacement of the roll and the wrapping material into one of a series of transport buckets carried on an endless conveyor. The ends of the wrapping material are folded over the roll after which the buckets transport the rolls through successive stations where pins are partially inserted into the core of each roll as the wrapper is folded over the ends of the rolls and about the pins which are then fully inserted to move the wrapped ends a slight distance into the core. The pins are then removed and rotating members are moved into engagement with sides of the roll for fully inserting the folded ends of the wrapping material into the core.

12 Claims, 11 Drawing Figures

METHOD AND APPARATUS FOR WRAPPING ROLLS OF PAPER

BACKGROUND OF THE INVENTION

This invention relates to packaging machinery and more particularly to a machine for wrapping rolls of paper products such as toilet paper.

Prior art machinery for wrapping rolls of paper products, such as toilet paper, generally include a product infeed section which transports the product rolls to the wrapping machinery and the second delivery system for the wrapping material. Generally, the wrapping material is cut to suitable lengths from a parent roll and then folded or rolled over the product so as to form a tubular configuration. In one prior art wrapping machine it was necessary to apply glue to the product for adhesion of the wrapping material prior to the rolling operation. This causes a loss of product and maintenance problems in the machine itself.

After the wrapping material has been folded into a tubular shape around the product, prior art wrapping machines then fold the ends of the wrapping material downwardly toward the axis of the product after which discs or plugs are employed for forcing the ends of the wrapping material into the product core.

Prior art machinery for packaging single rolls of toilet paper have not been wholly satisfactory because such machines were either relatively slow or did not provide a satisfactory package. For example, the wrappers of packages wrapped in prior art machinery sometimes had tears in the area where the wrapping material was inserted into the core or the wrapping material was not fully inserted thereby forming unsightly laps or folds of lapping material pressed against the side of the package.

SUMMARY OF THE INVENTION

It is an object of the invention to provide a new and improved wrapping machine for single rolls of material such as toilet paper.

Another object of the invention is to provide a machine for wrapping toilet paper rolls having a relatively high production rate.

A further object of the invention is to provide a machine for wrapping single rolls of toilet paper which can rapidly be adjusted to accommodate rolls of various sizes.

Yet another object of the invention is to provide a machine for wrapping single rolls of toilet paper which requires less maintenance than prior art machines.

A still further object of the invention is to provide a machine for wrapping single rolls of toilet paper which provides a better appearing package.

These and other objects and advantages of the present invention will become more apparent from the detailed description thereof taken with the accompanying drawings.

In general terms, one aspect of the invention comprises a wrapping machine which includes means for feeding individual pieces of wrapping material, vacuum belt means having spaced apart portions for engaging the upper surface of the wrapping material and for conveying the same in a first direction with the wrapping material being supported below the vacuum belt means. Plunger means is provided for displacing a product roll of material to be wrapped downwardly between the spaced apart portions of the vacuum belt means for moving the product roll therebetween and for engaging the wrapping material with the product roll to remove the wrapping material from the vacuum belt means. A generally U-shaped transporter means is disposed below the vacuum belt means for receiving the product roll and the wrapping material engaged by the roll so that the wrapping material assumes a U-shaped configuration in the transporter means. Wrapping means is provided for wrapping the sides of the wrapping material downwardly onto the roll to form a tube of wrapping material around the roll and folding and tucking means are provided for folding the ends of the tube of wrapping material downwardly around the ends of the roll and for tucking the same into the core.

According to another aspect, the invention comprises a wrapping machine for folding the ends of a cylindrical tube of wrapping material onto the ends of a product roll and for tucking the same into a hollow core. The machine includes first means for folding the cylindrical ends of the wrapping material inwardly as the roll is transported in along a translational path. Means are provided for moving one pair of a plurality of pairs of pins in a coaxial relation with the roll of material as the roll is translated and for simultaneously moving the pins inwardly toward the core of the roll from its opposite ends whereby the ends of the wrapping material are folded around the pins as the pins and the roll of material move in unison. Additional means are provided for cycling the pins inwardly into the core of the material after the wrapping material has been folded around the pins for forcing the wrapping material partially into the core and for thereafter removing the pins from the core. A pair of disc means are provided on the opposite sides of the translational path and each includes a projecting portion for extending into the core and means are provided which are operable after the removal of the pins for simultaneously moving the discs into engagement with the sides of the roll and for moving the projecting portion into the core and for simultaneously rotating the same for forcing the remaining wrapping material into the core.

Another aspect the invention comprises a receptacle for translating a roll of material through a wrapping machine, the receptacle including a body portion and at least a pair of finger portions extending from the body portion. The finger portions each have an arcuate internal surface corresponding to the arcuate surface of the roll of material. The finger portions are adjustably mounted on the body whereby the finger portions may be affixed to the body portion in successive positions on the body portions such that points on the arcuate surface of the finger portions are placed in successive positions which define a line extending downwardly at a 45° angle from the center of curvature of the finger portions whereby the axes of different sized rolls of material supported in the receptacle will all lie in the same position.

DETAILED DESCRIPTION OF THE PREFERRED EMBODIMENT

Figure 1:
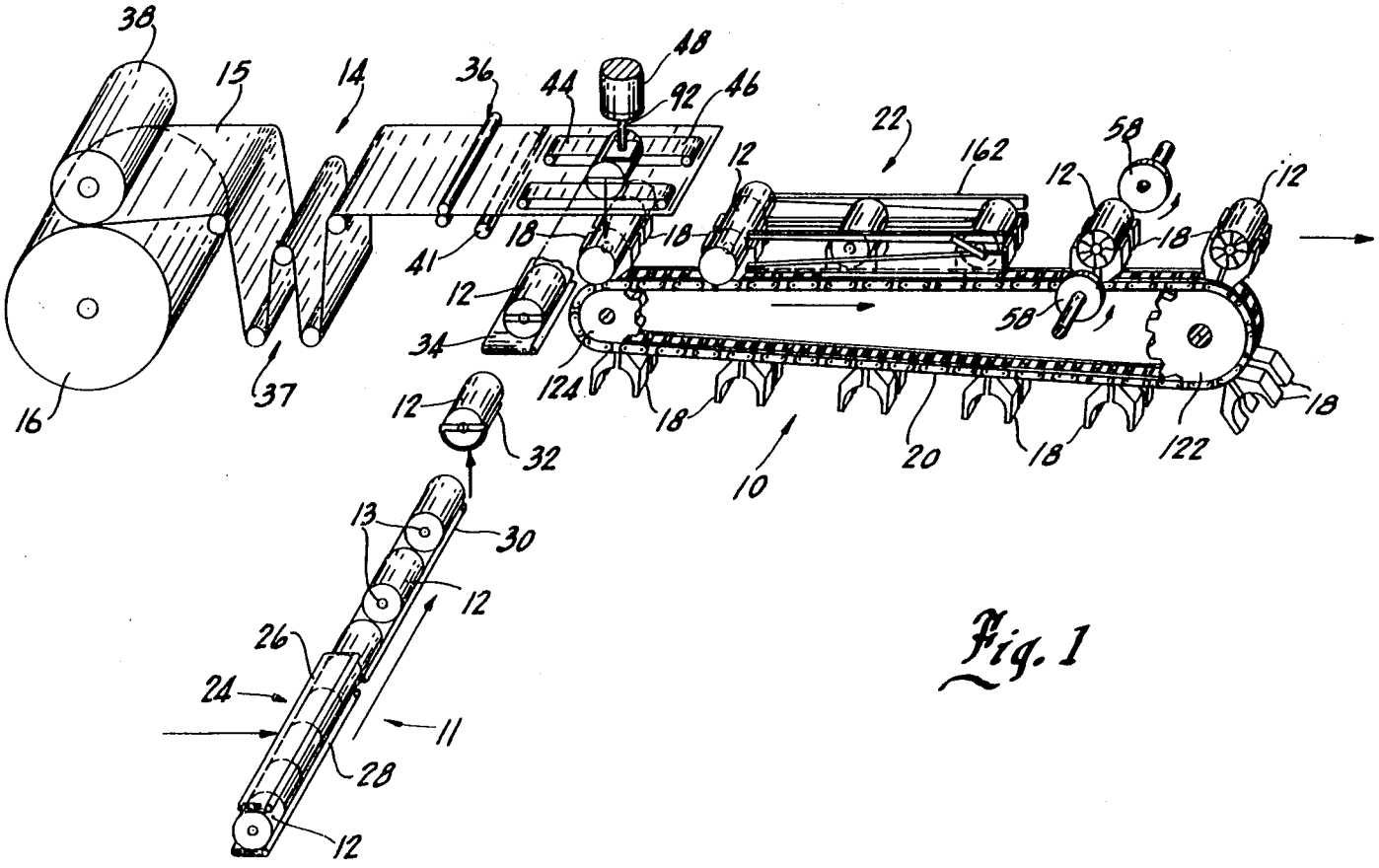
FIG. 1 schematically illustrates a wrapping machine which incorporates the present invention.

FIG. 1 schematically illustrates a wrapping machine 10 which incorporates the present invention. In particular, the wrapping machine 10 includes a product feeder 11 for feeding individual rolls of product, such as toilet paper rolls 12, to be wrapped. Each roll 12 is wound about a hollow, tubular core 13. A wrapping material feed section 14 delivers individual sheets of wrapping material 15 which are cut from a parent roll 16. The product feed section 11 delivers individual rolls 12 to a position above the sheet of material 15 into which it is to be wrapped. The roll 12 and the wrapping material 15 are then displaced downwardly into one of a plurality of bucket transporters 18 carried by a conveyor 20. The material 15 is then wrapped around the roll 12 as one of the buckets 18 carries the roll 12 and wrapping material 15 to a folding and crimp section 22 which folds and tucks the end of the wrapping material 15 into the hollow core of the roll 12. The wrapped rolls of material 12 are then discharged.

The product feed section is conventional and may include a choke conveyor 24 which generally includes spaced apart upper and lower belts 26 and 28 through which the rolls 12 pass. Such devices are generally adjustable so that the operator can increase or decrease the distance between the belts so as to adjust the holding pressure applied to the rolls. The belts 26 and 28 are generally uniformly driven from a common drive of their own. The purpose of the choke conveyor 24 is to permit the control of the rolls 12 which are received from a back conveyor so that the rolls can be separated from each other to facilitate wrapping.

The rolls 12 are fed from the choke conveyor 24 to a speed-up conveyor 30 which is also conventional. The speed-up conveyor 30 operates at a faster speed than the choke conveyor 24 so that the rolls 12 become spaced one from the other.

At the end of the speed-up conveyor 30, the rolls 12 move onto an elevator plate 32 which steps each roll 12 upwardly and moves the same onto a flight conveyor 34 which is also a conventional apparatus and accordingly will not be discussed in detail for the sake of brevity. It will be sufficient for purposes of understanding the invention to state that the flight conveyor 34 receives the rolls 12 from the elevator plate 32 and transports the same to a position above the feed path of the wrapping material 15.

Except as will be indicated herein below, the material feed section 14 is also conventional and therefor will be discussed in general terms except for those portions which form a part of the present invention. As those skilled in the art will appreciate, the material 15 is unwound from parent roll 16 by feed rollers 36 and dancing rollers 37. Tension control is provided by a surface unwind roller 38 which engages the top of the parent roll 16. The surface unwind roller 38 is driven by a variable speed D.C. motorized gear drive (not shown) whose speed is controlled by a potentiometer (not shown) that detects the position of the dancing rollers 37. This provides proper tension to permit the feed rollers 36 to unwind the wrapping material without undue tension which could cause tearing. In the event printed wrapping material is employed, a conventional registration system 39 (FIG. 3) may be employed between the feed rollers 36 and a conventional parallel index cam drive (not shown) to advance or retard the position of the wrapping material by rotation of the feed rollers 36 in respect to the position of an eye mark. A rotating knife 41 contacting a fixed anvil knife 42 (FIGS. 2 and 3) may be employed for cutting the wrapping material 15. The rotating knife 41 is preferably driven by the main machine drive 29 and continually rotates as long as the machine operates. Air cylinders 43 (FIG. 2) may be provided for raising or lowering the anvil knife in order to initiate or terminate the cutting of the wrapping material 15.

Normally, the wrapping material 15 will be fed only when the roll is properly sensed by a sensor, such as a photo eye (not shown) adjacent the flight conveyor 34. In the event an empty conveyor flight is sensed, the feed of wrapping material will be terminated by disengagement of a single revolution clutch (not shown) coupled to the feed roller drive shaft. In addition the anvil knife 42 will also be elevated to prevent slivers of the wrapping material from being cut. The rotating knife 41 is preferably provided with a spiral flexed blade 45 (FIG. 1) to provide a shear type cut of the wrapping material. Feed rollers 36 and the knife 41 are mounted in a housing which can be operator adjusted by a hand wheel with respect to the position of the bucket transporters 18 in the wrapping section 22 in order to increase or decrease the length of the wrapping material actually being cut. A phase control mechanism (not shown) allows the operator to manually adjust the actual knife cut position with respect to the position of the wrapping material 15 and enables precise timing of the knife cut.

After the wrapping material has been cut, it is transported by spaced apart vacuum belts 44 and 46 into a position beneath the ram 48 and above one of the bucket transporters 18. The belts 44 and 46 can be slightly canted off parallel in order to keep the wrapping material tight and are driven from the same parallel index cam that drives the feed rollers 36.

Except as otherwise specifically described, the various components of the wrapping machine 10 are suitably mounted on a frame consisting of a pair of side plates 50 and suitable cross-members which hold the plates 50 in a parallel spaced apart relation. It will also be understood by those skilled in the art that the various components are driven by various conventional belts and pulleys or sprockets and chains from the main drive 29. Accordingly, each of these drive couplings will not be separately discussed except where necessary for understanding the invention.

As the piece of wrapping material 15 moves into position above the initial bucket transporter 18 the flight conveyor moves the initial roll of paper 12 into position below a ram 51 which is then operated to force the roll 12 downwardly into the bucket along with the piece wrapping material which then assumes a generally U-shaped configuration. As will be discussed more fully below, the edges of the wrapping material are then folded around the roll so that the wrapping material now assumes a tubular configuration. The bucket 18 then moves the roll 12 with its surrounding sleeve of wrapping material 15 through the stationary folders 162 which wrap the material over both core ends of the roll. Simultaneously, pins 54 are moved into the center of each roll core 13 as the same are transported through the stationery folders 162. This enables the folders 162 to fold the wrapping material around the pins 54 which are in alignment with the centers of the respective cores 13.

As the roll is carried by the bucket 18 to the end of the stationary folders 162, a star wheel 55 (FIG. 3) is rotated to bring an arm 56 into engagement with the rear of the wrapping material to fold the same around the pin 54. Next, the pin 54 is moved into both ends of the core 13. This slightly pushes the wrapping material into the core. Next, twin rotating discs 58 are moved into both core ends by the rotating linear bearings to completely insert the wrapping material into the core ends. The discs are rotated in opposite directions to smooth the folded wrapping material at both sides. The wrapped roll may then be discharged.

Figure 4:
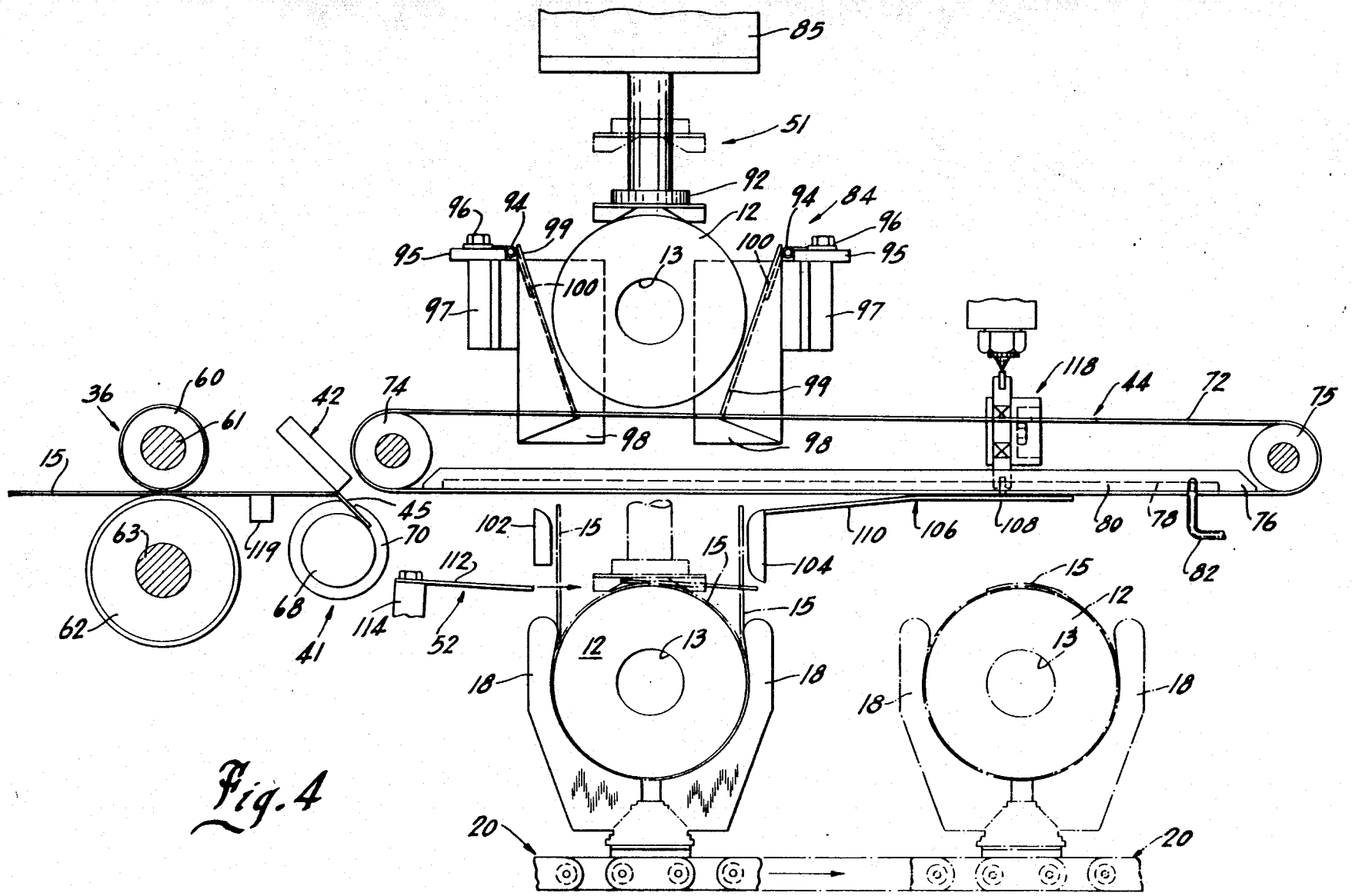
FIG. 4 shows a portion of the wrapping machine of FIG. 2 in greater detail.

Reference is now made to FIG. 4 which shows the initial wrapping operation in greater detail. Here, the feed rolls 36 are shown to include an upper roll 60 mounted on a shaft 61 and a larger diameter lower roll 62 mounted on a shaft 63. The shafts 61 and 63 are coupled to the machine's main drive shaft 29 through a parallel indexing cam drive 123 for intermittent rotation at the desired feed rate. The rolls 60 and 62 are preferably covered with a high friction material, such as rubber, to facilate feeding.

The shaft 61 of the upper roller 60 may be mounted on supports 65 (FIG. 2) which are pivotally mounted on the frame 50 and which may be pivoted upwardly by manually operable air cylinders 66 to permit the rollers 60 and 62 to be separated so that the material 15 may be threaded there through.

The knife 41 includes an elongate cylindrical member 68 which is driven from the main drive shaft 29 for continuous rotation and includes a blade 44 which is affixed to the cylindrical member 68 with a slight helix and which engages a fixed anvil knife 42. The helical advancement of the knife 45 and the rotary speed of the cylindrical member 68 will be such that a relatively square cut is made in the wrapping material 15 after it has been advanced to the right in FIG. 4 by the rollers 36.

The vacuum belt assembly 44 is shown in FIG. 4. It will be appreciated that the vacuum belt assembly 44 is disposed along one edge of the path of the wrapping material 15 and that another identical belt assembly 46 is disposed behind the belt assembly 44 as viewed in FIG. 4 and along the opposite side of the wrapping material. Because the belt assemblies 44 and 46 are identical, only one will be disclosed in detail for the sake of brevity. Vacuum belt assembly 44 includes an endless belt 72 which extends about a drive roller 74 and an idler roller 75 disposed in a parallel, horizontally spaced apart relation and with axes of rotation normal to the direction that the material 15 travels. The lower portion of belt 72 extends beneath an elongated vacuum member 76 which substantially spans the gap between the rollers 74 and 75. The member 76 has the shallow groove 78 in its lower surface, the edges of which are engaged by the belt 72 in a sealing relation. This defines a vacuum chamber 80 of which the belt 72 forms one side and the body 76 the other. The vacuum chamber 80 is connected by a pipe 82 to a vacuum pump (not shown) having a separate drive motor (not shown). Proper tension on belt 72 so as to maintain the vacuum within chamber 80 is provided by an adjustable idler roller 75. In addition, belt 72 is preferably perforated or porous so that a suction is produced thereby holding the wrapping material 15 in position. The drive roller 74 is driven from the same drive assembly as the rollers 36 but at a slightly faster speed.

Disposed above the gap between the vacuum belt assemblies 45 and 46 is the ram assembly 51 and a chute 84 which is also positioned at the end of the flight conveyor 34. The ram assembly 51 includes a vertically oriented plunger 85 coupled by a linkage 86 to a timing disc 87 which is also coupled to the speed variator cam drive. The linkage 86 includes a first link 88 fixedly connected at its upper end to the plunger 85 and a second link 89 is pivotally connected at 90 to the frame 50 and connected intermediate it ends to the timing disc 87 by link 91. A fourth link 92 connects the ends of links 88 and 89. A cross link 93 extends from the upper end of the link 88 to the upper end of the plunger 85. The ram 51 will be cycled each time the timing disc is rotated one revolution. A head 92 on the plunger 85 is contoured for engaging the outer surface of a roll 12 which is shown to be positioned in the chute 84.

The chute 84 includes a pair of gate members 95 which pivot about pins 96 extending from fixed supports 97 in general parallism with each other and perpendicular to the direction that the material 15 travels. Each gate member 95 may be formed by bending a flat sheet of metal to define a vertically oriented side plate 98 and an inclined front plate 99 which is generally perpendicular to the side plate 98. Torsion springs 100 which surround pins 94 and engage the gate members 95 and the supports 97 normally maintain the gate members 92 in the position shown in FIG. 4. In addition, the supports 97 are mounted so that the gate members 95 lie within the margins of the gap between belt assemblies 44 and 46 and generally above the path defined by the bucket transporters 18.

Figure 2:
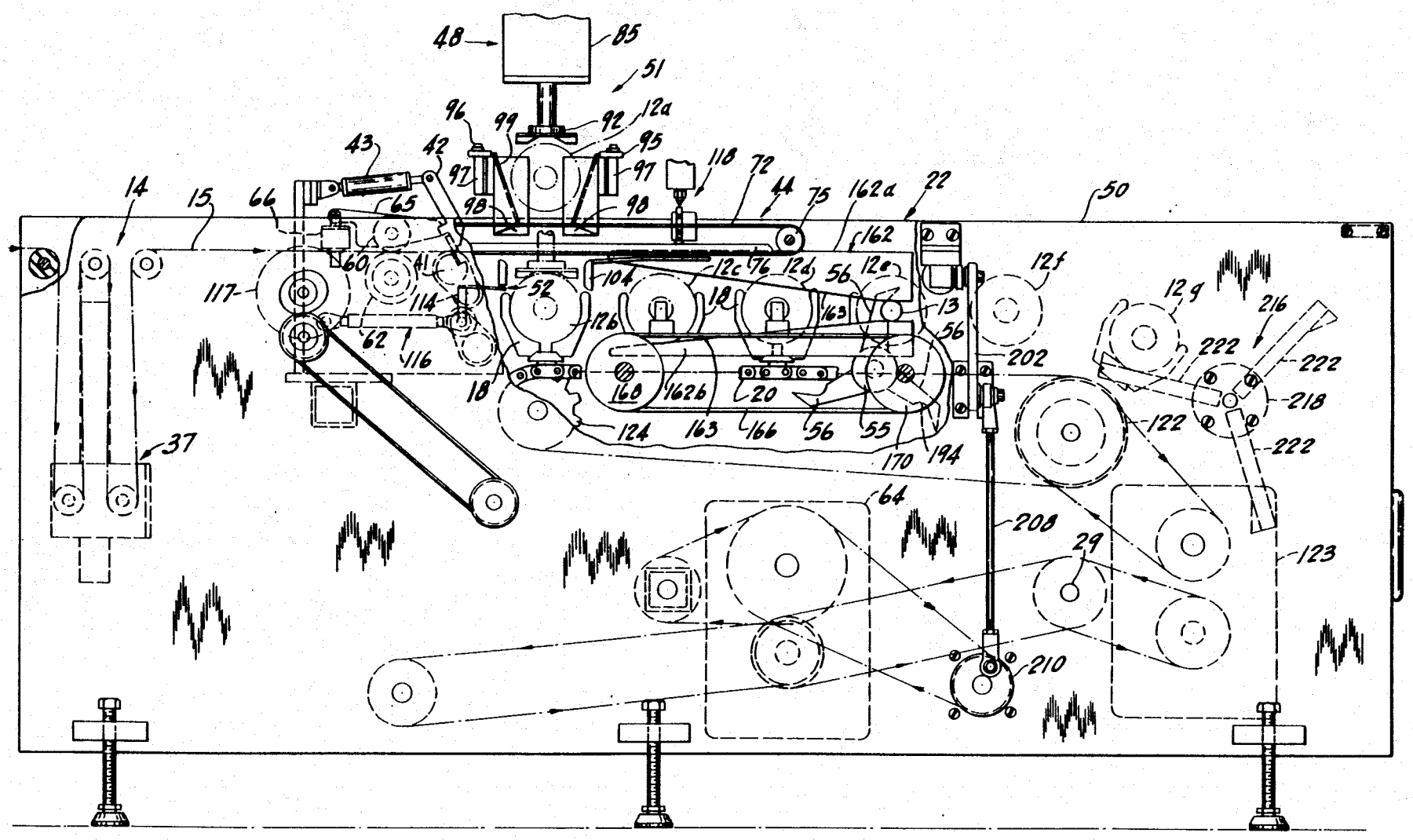
FIG. 2 is the side elevational view of a portion of the wrapping machine according to the preferred embodiment of the invention.

Disposed below the vacuum belt assemblies 44 and 46 and spanning the gap therebetween are a pair of parallel, spaced apart, generally parallel guide bars 102 and 104. In addition, a relatively flat guide member 106 also spans the gap between belt assemblies 44 and 46 and has a first portion 108 that is parallel to and spaced below belts 72 and an inclined portion 110 extending between portion 108 and the guide bar 104. Below the upstream ends of vacuum belt assemblies 44 and 46 is the top folder 52 comprising a plate 112 mounted atop a vertically extending ram member 114. As seen in FIGS. 2 and 4, the lower end of the ram member 114 is coupled by a link 116 to a timing mechanism which includes helical gears 117 which are coupled to the parallel indexing cam drive 123. In addition, a glue applicator 118 may be disposed above the downstream end of guide portion 108 and between the lower portions of the belts 72 of each vacuum belt assembly 44 and 46.

Figure 3:
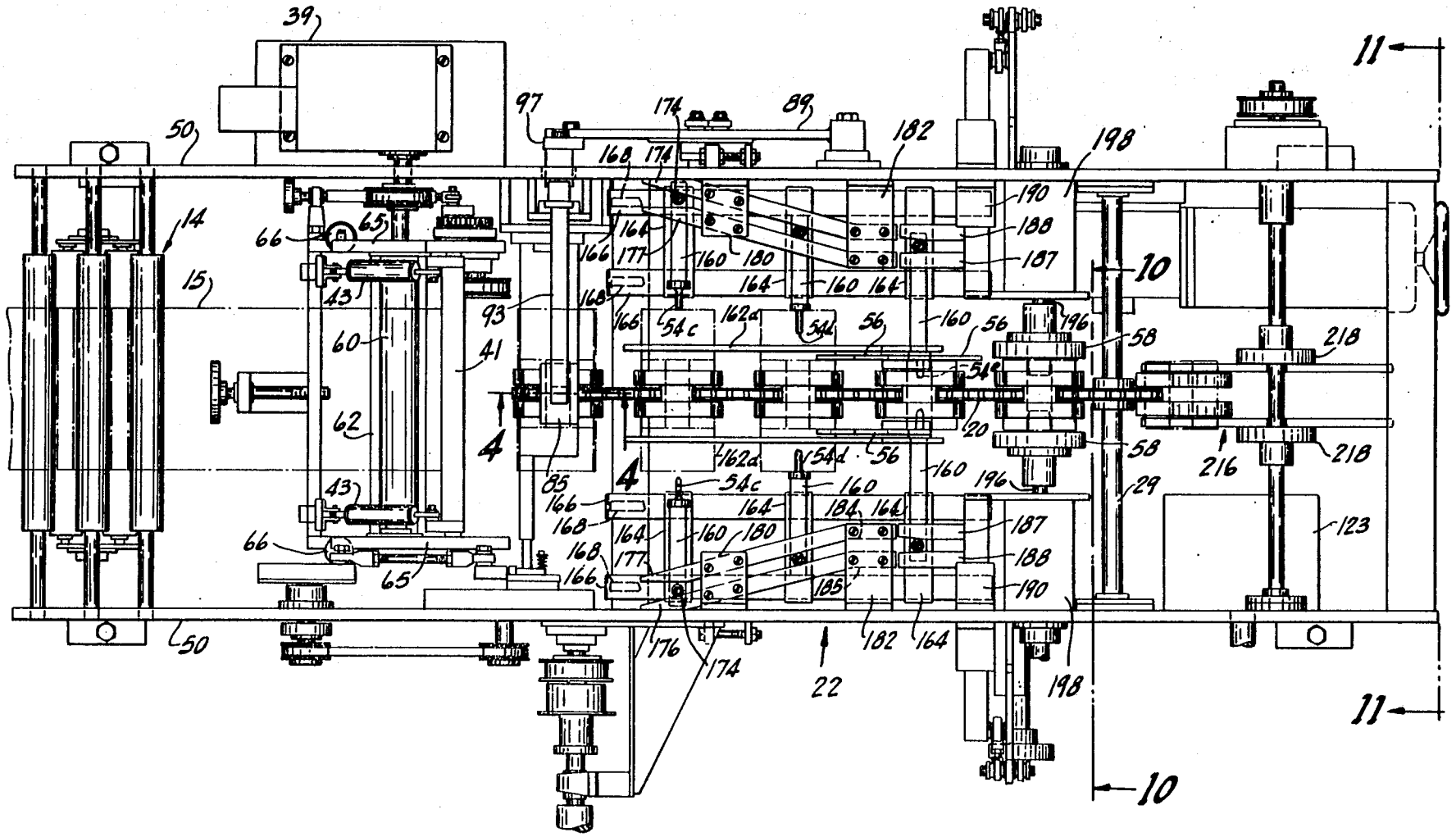
FIG. 3 is a top plan view of the wrapping machine shown in FIG. 2.

The operation of the portion of the apparatus as shown in FIG. 4 will now be discussed. As indicated above, the wrapping material 15 is delivered by the feed rolls 36 and over a guide bar 119 toward the upstream end of the vacuum belt assemblies 44 and 46. The suction produced by the belts 72 holds the paper 15 and transports the same in the downstream direction as shown in FIG. 3. After a predetermined length of wrapping material as passed the knife 41, the latter will be actuated to separate a piece of wrapping material 15 from the main body of the roll. At this time also, a small bead of glue is applied to the leading edge of the sheet wrapping material 15 and the upper surface by the glue applicator 118. In the meantime, a roll of material 12*a* to be wrapped has been delivered by the flight conveyor 34 to the chute assembly 84. The springs 100 hold the gate members 95 in the position shown in FIG. 4 so that the roll 12*a* is prevented from passing downwardly.

After the piece of wrapping material 15 has been cut and glue applied, the ram 51 is actuated to force the roll 12*a* downwardly into the bucket transporter 18 disposed therebelow. When in this position the roll is identified as 12*b*. This action also separates the piece of wrapping material 15 from the vacuum belts 72. At this time the trailing edges of the wrapping material will rest against the guide bars 102 and 104. When the roll 12 and the wrapping material 15 are in this position, the ram 51 will be retracted and the top folder 112 will be stroked from its position shown by full lines in FIG. 4 to its position shown in broken lines wherein the left hand portion 15 of the wrapping material will be folded over the roll 12. Simultaneously, the bucket 18 will be transported to the right from its position shown by full lines to its position shown by broken lines whereupon the guide bar 104 will force the right hand portion of the wrapping material downwardly onto the roll 12 as shown by broken lines in FIG. 4 whereupon the bead of glue will bond the two edges together. This has been exaggerated in FIG. 4 for purposes of illustration. At this time, the wrapping material 15 will take the form of cylinder around the roll 12 of paper to be wrapped.

The bucket transporters 18 and the conveyor 20 are shown more particularly in FIGS. 2, and 4–9. In particular, the conveyor 20 comprises a chain 120 which extends around a drive sprocket 122 and an idler sprocket 124. The drive sprocket 122 is driven by a parallel index cam box 123 connected to the main drive shaft 29 so that the individual bucket transporters 18 will be stepped in synchronism with the delivery of rolls 12 and the wrapping material 15. As seen in FIGS. 2, a plurality of buckets 18 are mounted on chain conveyor 20 so that a plurality of rolls of material 12 will be advanced incrementally in succession through the various stages of the folding section 22. In particular, the buckets 18 will be stepped sequentially so that the rolls 12 are moved successively in increments between the positions identified as 12*b*, 12*c*, 12*d*, 12*e* and 12*f*.

Figure 9:
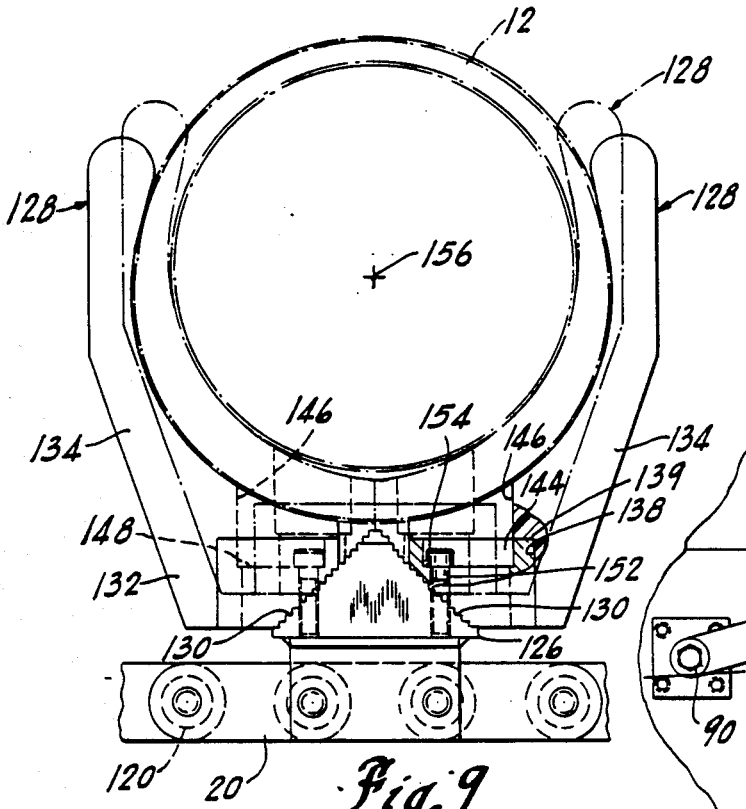
FIG. 9 is a side view of the bucket transporter of FIGS. 1 and 7.
Figure 7:
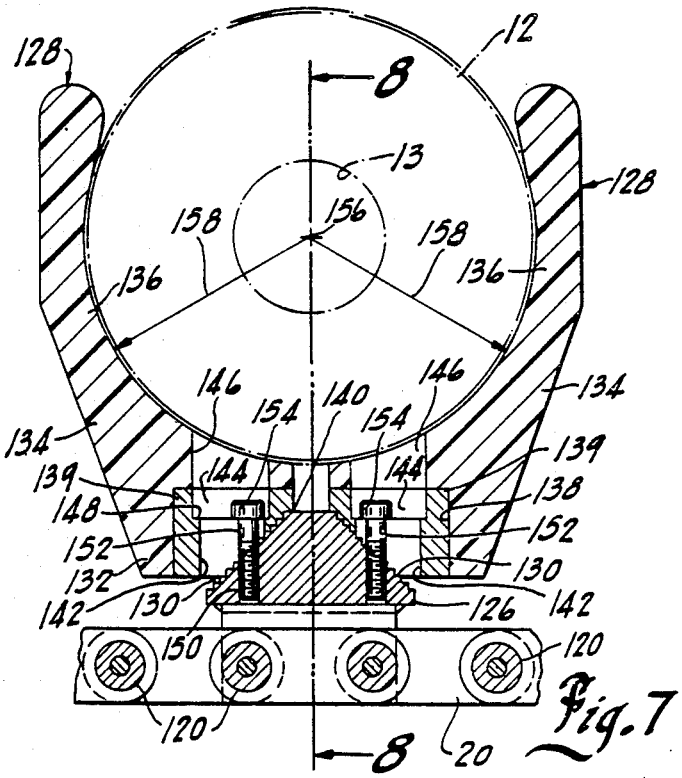
FIG. 7 is a sectional view of a portion of the wrapping machine shown in FIG. 1.
Figure 8:
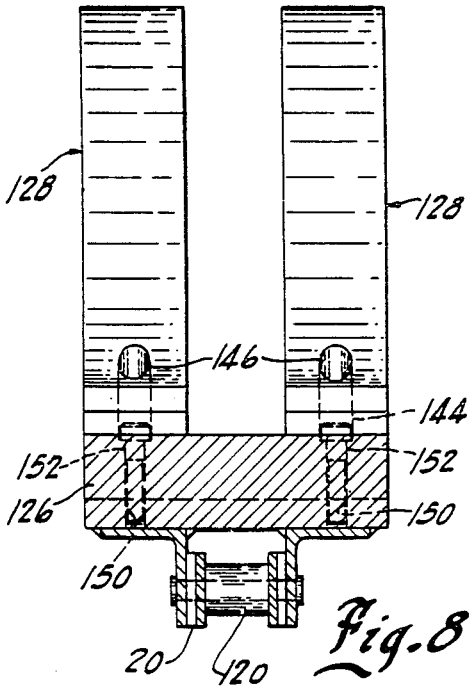
FIG. 8 is a view taken along lines 8—8 of FIG. 7.
Figure 6:
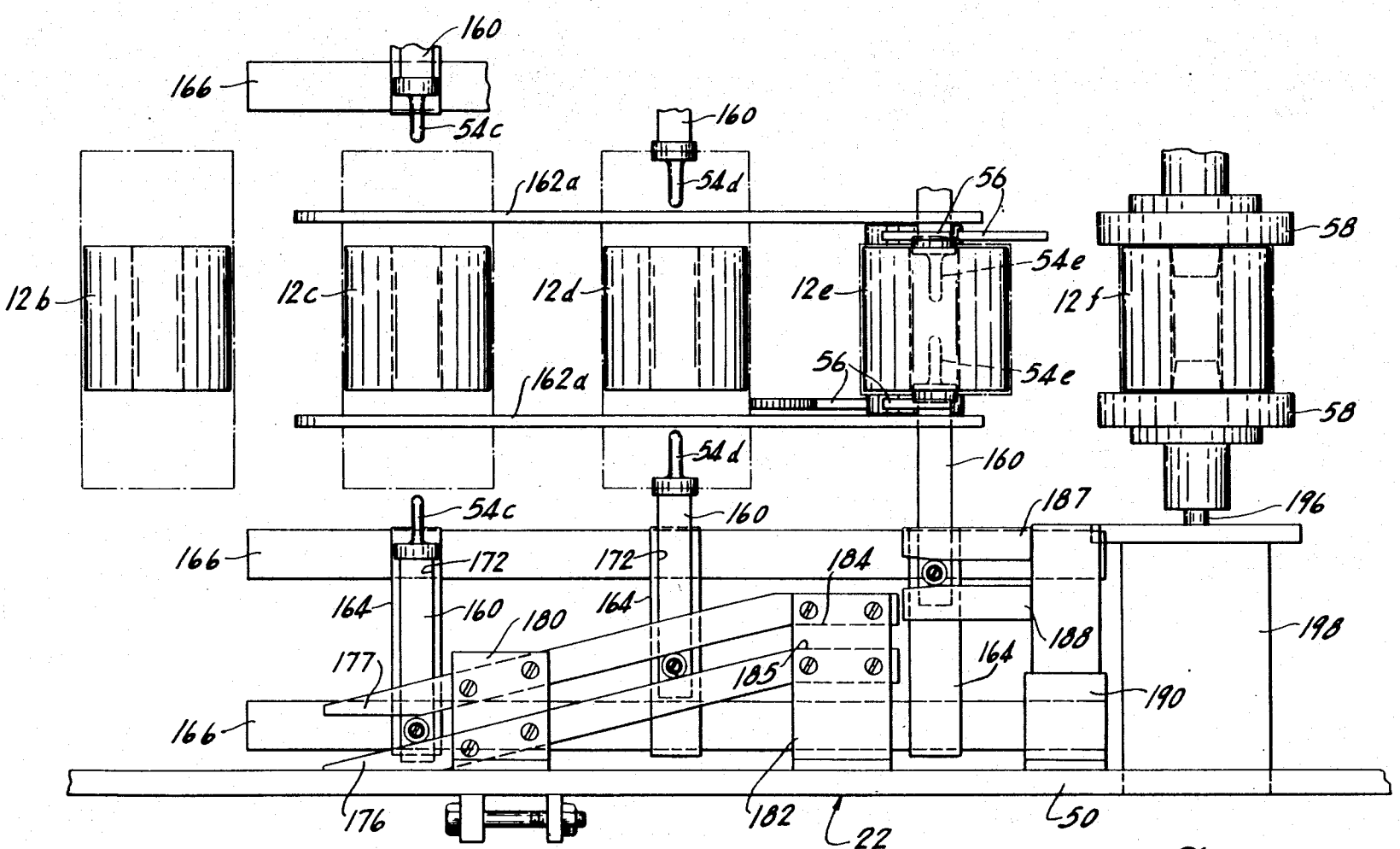
FIG. 6 shows another portion of the wrapping machine shown in FIG. 3 in greater detail.
Figure 10:
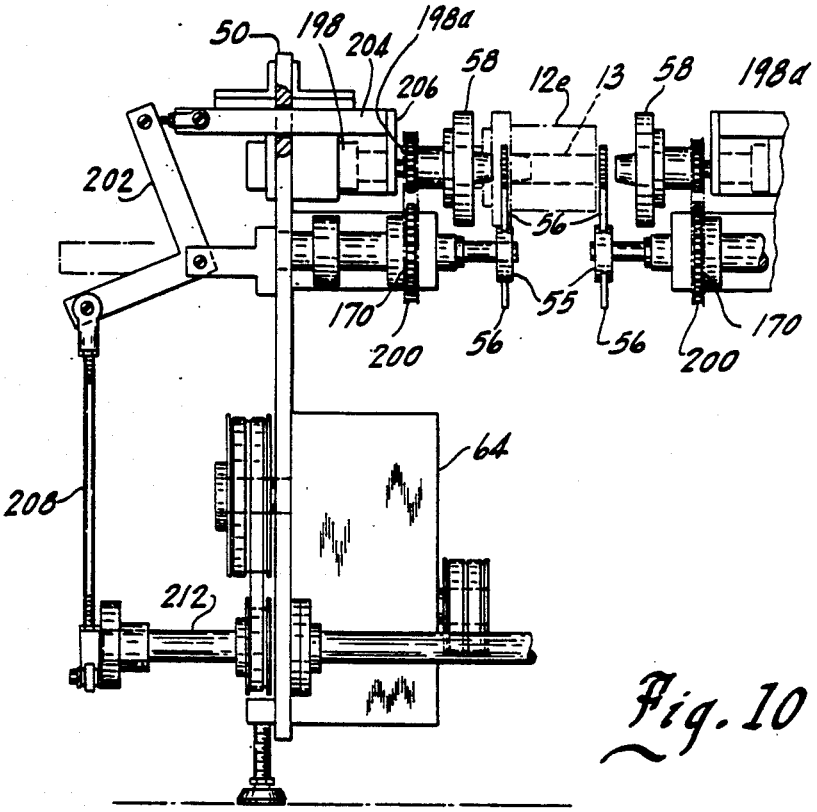
FIG. 10 is a view taken along lines 10—10 of FIG. 3.
Figure 11:
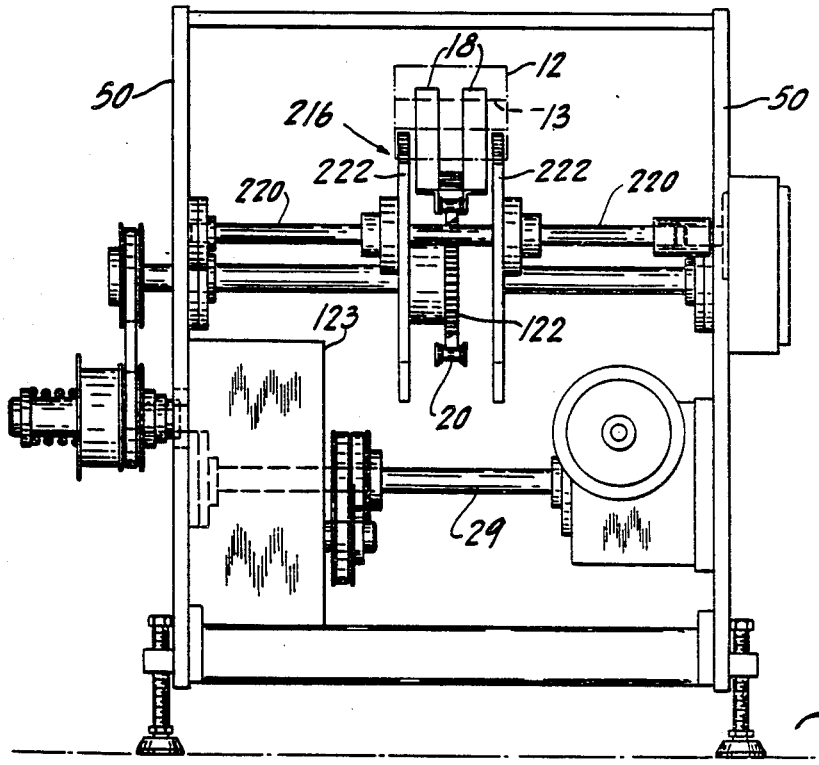
FIG. 11 is a view taken along lines 11—11 of FIG. 3.

The individual bucket transporters 18 are shown in FIGS. 7–9 to include a body member 126 and four fingers 128 which are releasably securable to the body members 126 in a plurality of positions which permit the bucket 18 to be adjusted for accommodating rolls of different diameters. More particularly, each body member 126 is generally elongate and has steplike formations 130 extending along each side so that the member is generally triangular in vertical section. Each finger 128 includes a base 132 and an upwardly projecting generally arcuate finger portion 134. Each finger portion 134 has a generally arcuate inwardly facing surface 136. The fingers 128 are arranged in opposed pairs so that the surfaces 136 define a generally cylindrical section for receiving the roll 12 of material to be wrapped. The finger portions 134 are preferably formed of a flexible material such as urethane so that the upper ends may spread slightly when the roll 12 is displaced downwardly and for returning to their original position to provide a gripping action.

Figure 5:
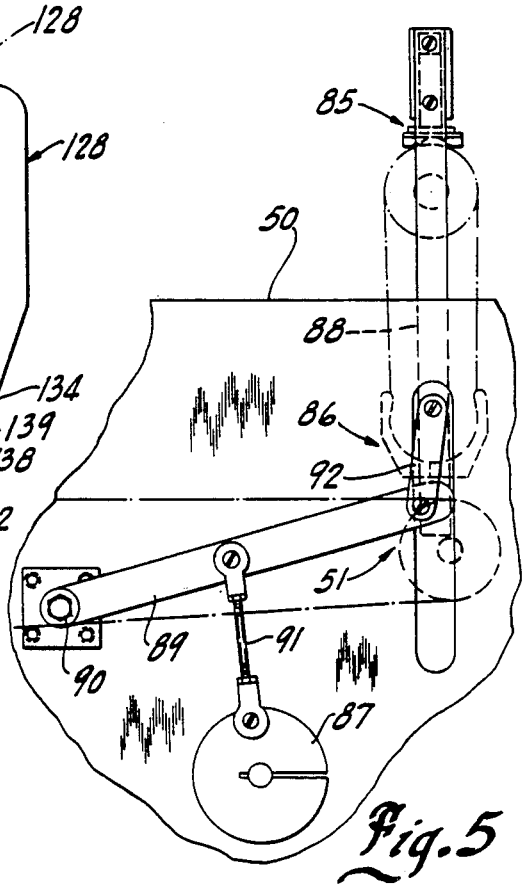
FIG. 5 illustrates another portion of the wrapping machine shown in FIG. 2 in greater detail.

The base 132 of each finger 128 has a recess 138 for receiving a metallic insert 139. The outer face of insert 139 has a steplike formation 140 formed thereon which is complementary to the steplike formation 130 of the body 126. In addition, the base 132 of finger 128 and the insert 139 have complementary elongated slots 142 and 144 respectively extending vertically downwardly therethrough. At the upper end of the slot 144 a recess 146 is formed to define a shoulder 148. There are also a pair of threaded holes 150 extending vertically through the body 126 and intersecting the steplike formations 130. In this manner, each of the fingers 128 can be securred to the body 126 by means of bolts 152. As seen in FIG. 7, each of the bolts 152 has a head 154 which engages the shoulder 148 and a threaded shank which is received in one of the holes 150. In this manner, each finger 128 is releasably secured to the body 126 with the steplike formations 140 in engagement with the steplike formations 130 on the body 126. It will be appreciated that by loosening the bolts 152, fingers 128 can be repositioned on the body 126 so that they will be at a different elevation relative to the steplike formation 130. When the bucket 18 is oriented vertically as shown in FIGS. 5 and 7, the steplike formations 130 and 140 are symetrical about planes inclined at 45° relative a vertical plane, repositioning the fingers 128 will move each radially outwardly and downwardly in a direction 45° from the center of curvature 156 of the surfaces 136. This provides two beneficial effects. Firstly, by repositioning the fingers 128 on the body 126, rolls 12 of different diameters can be accommodated. As the surfaces 136 are moved inwardly or outwardly in a radial direction defined by the arrows 158. Secondly, because the surfaces 136 move in a radial direction relative to their center of curvature 156, the center of rolls of various size will remain at the center of curvature 156 regardless of the positons of the fingers 128 on the body 126. This is important for the proper operation of the folding and crimp section 22 which will be discussed below.

The folding and crimp section 22 is shown in FIGS. 2 and 3. As indicated above, the section includes stationary folders 162, pins 54, a star wheel 56 and rotating discs 58. The stationary folders 162 comprise pair of parallel plates 162 each having a generally triangular cutout 163 to define upper and lower arms 162*a* and 162*b*. The cutout 163 is arranged so that the its upstream end exceeds the diameter of the circular tube formed by the wrapping material 15 around the roll 12 and tapers inwardly so that its downstream end is substantially equal to the diameter of the core 13 of roll 12. As seen in FIG. 3, the plates 162 are disposed on the opposite sides of the conveyer 20 and spaced apart from each other a distance slightly greater than the width of the rolls being wrapped.

The pins 54 are each slidably mounted for movement in a horizontal direction on one of a series of slide bearings 164 which are affixed to a chain 166 extending around sprockets 168 and 170 suitably mounted for rotation on the frame 50 and driven by the parallel index cam box 123 so that the pins 54 step in unison with the bucket transporters 18. A lug 174 extends upwardly from pin 54 into a cam track defined by a pair of parallel track members 176 and 177 which are suitably supported from the frame 50 by means of brackets 180 and 182 so that they angle inwardly from their upstream to their downstream ends and toward the folding members 162. Disposed at the inner ends of the tracks 176 and 177 and below the bracket 182 is a second pair of track members 184 and 185 which are spaced apart a distance equal to that between the tracks 176 and 177 and form a continuation thereof but are oriented in the direction parallel to that in which the rolls 12 travel. Disposed at the end of the tracks 184 and 185 there is a pair of floating tracks 187 and 188. The floating tracks are mounted on a plunger 190 which is slidably mounted on the frame 50 for movement in a direction normal to the travel path. The pins 54 and the linear bearing guides 164 are spaced apart on belt 166 a distance equal to the distance between the bucket transporters 18. In addition, the axis of the pins 54 are concentric with the axis of the cores 13 of a roll 12 as the same are stepped in the downstream direction.

Adjacent the ends of and below the folding members 162 and on the outer side thereof is a pair of star wheels 55. Each wheel has a plurality of arms 56 radiating axially therefrom and each arm has a recess 194 formed adjacent the end of its forward surface. The star wheels 55 are rotatable in synchronism with the chain 20 and the recesses 194 are positioned from the center of wheel 55 such that it will be in a complementary position relative to the core 13 and each roll 12 as the same reaches the end of cutout 163.

The rotating discs 58 are each mounted on a shaft 196 which is rotatably mounted on a bearing 198 affixed to the frame 50. Also affixed to shaft 196 is a gear 198*a* which meshes with the second gear 200 rotatably mounted therebelow and coupled to the main drive 29. In addition, a crank arm 202 is pivotally mounted on the frame 50 and one arm thereof is pivotally connected to a sliding link 204 coupled at its other end to the plunger 190 which slidably engages the disc 58. Crank 202 is also pivotally connected to a link 208, the other end of which is pivotally connected to an eccentric 210 mounted on shaft 212 rotatably mounted on the frame 50 and coupled to the main machine drive 29. It will be appreciated that each time the shaft 212 rotates, the crank 202 will be pivoted from its full line to its broken line position thereby translating link 204 longitudinally to move the disc 58 and the tracks 187 and 188 inwardly. This also moves one of the pins 54 into the core 13 of roll 12*e* and simultaneously moves the discs 58 into the core of the downstream roll 12*f*. Continued rotation of the shaft 212 will return the crank 202 to its full position. It will be appreciated that as the shaft rotates, the disc 58 and the pin 54 will be cycled into and out of the cores of rolls 12*e* and 12*f* as they are displaced in coaxial positions by the buckets 18. The shaft 212 will be rotated at such a speed and in coordination with the other drive components of the machine such that the downstream pin 54 and the disc 58 will be cycled into the core of each roll 12 as it moves into a coaxial position.

An ejector mechanism 216 is disposed downstream of the discs 58 and includes a pair of circular support members 218 each mounted for rotation on a shaft 220 which is, in turn, journalled for rotation on the frame 50. As seen in FIGS. 2 and 3, pairs of arms 222 on the members 218 are disposed in a parallel spaced apart relation with the spacing therebetween being slightly greater than the width of the bucket 18. The shaft 220 is driven from the main drive 29 in synchronism with the other components and at a speed such that a pair of arms 220 will pass a bucket 18 as the latter begins moving around the sprocket 122. In this manner, the pair of arms 222 will lift the roll 12*g* from the bucket 18 and continued rotation of the circular members 218 will move the roll onto a further conveyor (not shown) for shipment or storage.

From the foregoing description it will be appreciated that after the wrapping material 15 has been formed in a tubular configuration about the roll 12 as discussed with respect to FIG. 4, it will be carried in its respective bucket toward the folding members 162. It will be recalled that there are a pair of such members disposed on the opposite sides of the path through which the buckets 18 transport the rolls 12 and the horizontal distance between the folding members 162 on the opposite sides of the machine will be slightly larger than the width of each roll 12. As a result, movement of the rolls to the right, as viewed in FIG. 2, will cause the portions of the wrapping material which extend beyond the ends of the roll 12 to be compressed inwardly from the opposite sides. In addition, as the rolls move in the downstream direction, the pins 54*c* will be moved into axial alignment with the core 13 of roll 12*c*. Because of the synchronism between the chains 20 and 164, the pin will remain in axial alignment as the roll 12*c* and its surrounding wrapping material 15 is stepped toward the right as viewed in FIG. 2. In addition, as the pins 54 move toward the right, the engagement of the lug 174 between the tracks 166 and 176 will move the pins 54 axially inwardly on the slide bearings 172 and toward the core 13. As the result, the wrapping material 15 will be folded around the pins 54 as the rolls 12 move downwardly between the folding members 162. As the roll 12 moves into the position identified as 12*e*, its core 13 will be in alignment with the space provided between the arms 162*a* and 162*b*. This will fold the front side of the packaging material about the pin 54*e* and simultaneously, one of the arms 56 of starwheel 55 will engage the rear side of the packaging material to simultaneously fold that against the pin 54*e*. At the same time also, the pin 54*e* will be plunged inwardly as shown in FIG. 4 so that the wrapping material formed therearound will be forced partially into the core 13. The pins 54*d* will then be withdrawn from the cores 13 and the roll 12 move to the position 12*f* whereupon the discs 58 will be cycled inwardly and rotated to force the remaining portion of the wrapping material and into the core. The roll 12 will then be moved to the position 12*g* and discharged as discussed above.

While only a single embodiment of the invention has been illustrated and described, it is not intended to be limited thereby but only by the scope of the appended claims.

I claim:

1. In a wrapping machine means for folding the ends of a cylindrical tube of wrapping material onto a product roll disposed therein, said roll having a central core, and comprising:

first translating means for moving said product roll and said cylindrical tube of wrapping material in a direction normal to the axis of the cylindrical tube, first means for folding the cylindrical ends of said wrapping material inwardly as said roll is translated in the normal direction, a pair of pin means, pin translating means being operative for cycling said pin means inwardly into the core of said roll of material after the wrapping material has been folded therearound for forcing the wrapping material ends partially into said core and for thereafter removing the pin means, and tucking means engageable with the opposite ends of said roll after the removal of the pin means therefrom and including a pair of circular discs each of which has a generally planar face having an area greater than the area of the ends of said roll and a projection portion for extending into the core of said roll, and means for simultaneously moving said discs into engagement with said roll and for moving said projecting portions into said core and for rotating said discs in opposite directions for forcing the remaining wrapping material into said core and tightening the wrapping material on the ends of said roll between said roll and said planar faces of said discs.

2. The wrapping machine set forth in claim 1 wherein said first translating means include a plurality of receptacles each adapted to support a product roll and a generally cylindrical tube of wrapping material disposed therearound said first translating means being operative to step said receptacles and the rolls of material therein through successive positions in said normal direction.

3. The wrapping machine set forth in claim 2 wherein said folding means comprises stationary means disposed on the opposite sides of said first translating means and having converging edge portions extending in the normal direction, said edge portions means moving the ends of the cylindrical tube of wrapping material inwardly toward the axis thereof as the product roll is moved in the normal direction.

4. The wrapping machine set forth in claim 1 wherein said folding means comprises stationary means disposed on the opposite sides of said first translating means and having converging edge portions extending in the normal direction, said edge portions means moving the ends of the cylindrical tube of wrapping material inwardly toward the axis thereof as the product roll is moved in the normal direction.

5. A receptacle for translating a generally cylindrical roll of material through a wrapping machine, said receptacle including a body portion and at least a pair of finger portions extending from said body portion, said finger portions each having an arcuate internal surface corresponding to the arcuate surface of said roll of said material, wherein said body portion includes a first plurality of formations extending in a longitudinal direction and defining a series of support surfaces on each side of the body portion, lines connecting corresponding portions of said support surfaces on each side of said body portion forming an angle of substantially 45° with a line bisecting said body portion, and a plurality of corresponding support surfaces formed on each of said finger portions whereby each of said finger portions is engageable with one of said plurality of support surfaces whereby each finger portion may be adjustably supported on said body portion in a plurality of positions which define said 45° angle on said body portion, such that in each successive position on the body the arcuate surfaces of the finger portions are placed in successive positions which define a line extending 45° downwardly from the center of curvature of the finger portion whereby the axes of different sized rolls of material supported in the receptacle will all lie in the same position, and means for releasably securing each of said finger portions in each of said positions.

6. The receptacle set forth in claim 5 wherein each of said formations on said body portion and said finger portion comprises a plurality of steps so that the steps on said finger portion may be engaged with different steps on said body portion so that said steps may be located in various positions on said body portion.

7. The receptacle set forth in claim 6 and including an elongate slot formed in each of said finger portions and extending in a direction normal to said steps, a threaded hole in each of said body portions and threaded means engageable with said holes and said slot to permit said finger portions to be affixed to said body portions and the plurality of positions.

8. The receptacle set forth in claim 7 wherein the arcuate surface on each of said finger portions engages one side of a roll of material disposed therein, said finger portions being formed of a resilient material which permits said finger portions to spread as the roll of material was inserted into position and for resuming their original shape for resiliently holding said roll.

9. The receptacle set forth in claim 5 wherein the arcuate surface on each of said finger portions engages one side of a roll of material disposed therein, said finger portions being formed of a resilient material which permits said finger portions to spread as the roll of material was inserted into position and for resuming their original shape for resiliently holding said roll.

10. In a wrapping machine for wrapping a product roll having a hollow core, said machine including:

wrapping material feed means, application means connected to said feed means, for applying the wrapping material received from said feed means to form a coaxial cylinder around a generally cylindrical product roll, means for folding the wrapping material as applied to said product roll around the ends of said rolls, means for inserting a substantial amount of the wrapping material at the ends of said roll into the core of said roll, and final tucking and wrapping disc means distinct and separate from said inserting means and engageable with the opposite ends of said roll, said tucking and wrapping disc means comprising:

an opposing pair of generally circular, planar faces having an area greater than the area of the ends of said roll, a projecting portion on each of said faces, said projecting portion concentrically attached to each of said faces, means for simultaneously moving said disc means into engagement with said roll, and means for rotating said disc means while engaging said roll so as to force the remaining wrapping material into the core of said roll and tighten the wrapping material on the ends of said roll.

11. The wrapping machine as recited in claim 10 wherein said opposing faces of said disc means rotate in opposite directions.

12. The wrapping machine as recited in claim 11 wherein said projecting portions are tapered cylinders, each of the cylinders having one end attached to said face and the diameter of the cylinders decreasing away from said faces, the maximum diameter being approximately equal to the diameter of the core of said roll.

* * * * *